US007674962B2

(12) United States Patent
Gonzalez Ramirez

(10) Patent No.: US 7,674,962 B2
(45) Date of Patent: Mar. 9, 2010

(54) HARP WITH EXPOSED SOUNDBOARD AND SEPARATE BRIDGES AND METHOD OF ALTERING THE PITCH OF THE HARP STRINGS

(76) Inventor: Mariano Gonzalez Ramirez, 5415 W. Harmon Ave. #1008, Las Vegas, NV (US) 89103

( * ) Notice: Subject to any disclaimer, the term of this patent is extended or adjusted under 35 U.S.C. 154(b) by 237 days.

(21) Appl. No.: 11/945,811

(22) Filed: Nov. 27, 2007

(65) Prior Publication Data

US 2009/0133562 A1 May 28, 2009

(51) Int. Cl.
*G10D 1/04* (2006.01)

(52) U.S. Cl. ..... 84/264; 84/7; 84/266; 84/297 R; 84/307

(58) Field of Classification Search ..... 84/264
See application file for complete search history.

(56) References Cited

U.S. PATENT DOCUMENTS 1,563,141 A * 11/1925 Aslanian ..... 84/264
1,817,951 A * 8/1931 Starke ..... 84/264
3,739,680 A * 6/1973 Christiansen ..... 84/266
4,936,182 A * 6/1990 Bunker ..... 84/266
5,140,883 A * 8/1992 Fay ..... 84/266
5,796,020 A * 8/1998 Truitt ..... 84/266
6,008,439 A * 12/1999 Kovac et al. ..... 84/264
6,080,921 A * 6/2000 Cunningham ..... 84/266
7,534,954 B1 * 5/2009 Cassista ..... 84/731

* cited by examiner

*Primary Examiner*—Jeffrey Donels
*Assistant Examiner*—Christopher Uhlir
(74) *Attorney, Agent, or Firm*—Veronica-Adele R. Cao; Weiss & Moy, P.C.

(57) ABSTRACT

A harp is disclosed. The harp that allows for more simplified pitch change. The harp allows for the creation of a pitch bend effect, similar to the sound of the twang of a guitar. The harp also allows for rising half tones in the strings, wherein the pitch of a string is raised by exactly one semitone. Because of the various ways to change the pitch, each string in the harp is capable of playing up to three different notes.

20 Claims, 5 Drawing Sheets

HARP WITH EXPOSED SOUNDBOARD AND SEPARATE BRIDGES AND METHOD OF ALTERING THE PITCH OF THE HARP STRINGS

FIELD OF THE INVENTION

This invention relates generally to string instruments and, more specifically, a harp and method of playing therefor.

BACKGROUND OF THE INVENTION

A harp is a stringed instrument that has a neck, a resonator, and strings. A harp's strings may be made of nylon, gut, wire, or silk and are positioned perpendicular to a soundboard.

Most European-derived harps have a single row of strings with strings for each note of the C Major scale. All F strings are black or blue and all C strings are red or orange. The harp rests between the knees of the harpist and along his/her right shoulder. The first four fingers of each hand are used to pluck the strings; the pinky fingers are too short and cannot reach the correct position without distorting the position of the other fingers. However, on some folk harps with light tension, and closely spaced strings, the pinky fingers may occasionally be used. Also, the pinky is not strong enough to pluck a string. Plucking with varying degrees of force creates dynamics. Depending on finger position, different tones can be produced. For example, a fleshy pluck (i.e. near the middle of the first finger joint) will make a warm tone, while a pluck near the end of the finger will make a loud, bright sound.

A pedal harp is large and technically modern. It is designed for classical music and played solo, as part of chamber ensembles, and in symphony orchestras.

The pedal harp uses the mechanical action of pedals to change the pitches of the strings. There are seven pedals, one for each note, and each pedal is attached to a rod or cable within the column of the harp, which then connects with a mechanism within the neck. When a pedal is moved with the foot, small discs at the top of the harp rotate. The discs are studded with two pegs that pinch the string as they turn, shortening the vibrating length of the string. The pedal has three positions. In the top position, no pegs are in contact with the string and all notes are flat. In the middle position, the top wheel pinches the string, resulting in a natural. And in the bottom position, another wheel is turned, shortening the string again to create a sharp.

Folk harps use levers or blades to change pitch. Folk harps with levers installed have a lever close to the top of each string. When the lever is engaged, the string is shortened so that its pitch is raised a semitone, resulting in a sharped note if the string was a natural, or a natural note if the string was a flat. Blades and hooks perform almost the same function as levers, but use a different mechanism.

This instrument has several unique features. The harp neck is designed so that the strings come from the center of the neck, eliminating the tendency for the neck to roll over to the left because of string tension. Since the pillar and soundboard do not need to be extra strong to accommodate this unbalanced tension, the whole instrument weighs far less than a comparable Irish harp.

SUMMARY OF THE INVENTION

It is an object of the present invention to provide a harp that allows for at least one means of changing the pitch of a string.

It is another object of the present invention to provide a harp that allows for the creation of a pitch bend effect, similar to the sound of the twang of a guitar.

It is another object of the present invention to provide a harp that allows for rising half tones in the strings.

It is another object of the present invention to provide a harp wherein each string is capable of playing three notes.

BRIEF DESCRIPTION OF THE PREFERRED EMBODIMENTS

In accordance with one embodiment of the present invention, a harp is disclosed. The harp comprises a soundboard, a neck extending outwardly from a top end of the soundboard, a column extending downwardly from a distal end of the neck, a foot coupled to a bottom end of the column and to a bottom end of the soundboard, a plurality of tuning pegs coupled along a top surface of the neck, a plurality of strings, each string being coupled at one end to the neck and coupled at another end to the soundboard, and means for creating rising half tones in the strings.

In accordance with another embodiment of the present invention, a harp is disclosed. The harp comprises a soundboard, a neck extending outwardly from a top end of the soundboard, a column extending downwardly from a distal end of the neck, a foot coupled to a bottom end of the column and to a bottom end of the soundboard, a plurality of tuning pegs coupled along a top surface of the neck, a plurality of strings, each string being coupled at one end to the neck and coupled at another end to the soundboard, and means for creating a pitch bend effect on a string.

In accordance with another embodiment of the present invention, a harp is disclosed. The harp comprises an exposed soundboard comprising: a top portion; a bottom portion; and an open space defined by the top portion and the bottom portion, a neck extending outwardly from a top end of the soundboard, a column extending downwardly from a distal end of the neck, a foot coupled to a bottom end of the column and to a bottom end of the soundboard, a plurality of tuning pegs coupled along a top surface of the neck, a plurality of strings, wherein each string is coupled at one end to the neck, passes through the top portion of the soundboard, is coupled to the bottom portion of the soundboard, and traverses the open space defined by the top portion and the bottom portion of the soundboard, wherein bending a string within the open space causes a pitch bend effect on the string, and a plurality of bridges coupled along a top surface of the top portion of the soundboard, each bridge being positioned at a predetermined distance from the top surface of the top portion of the soundboard, wherein pressing a string against a corresponding bridge raises the pitch of the string by a semitone.

In accordance with another embodiment of the present invention, a method of playing a harp is disclosed. The method comprises the steps of providing a harp comprising a soundboard, a neck extending outwardly from a top end of the soundboard, a column extending downwardly from a distal end of the neck, a foot coupled to a bottom end of the column and to a bottom end of the soundboard, a plurality of tuning pegs coupled along a top surface of the neck, and a plurality of strings, each string being coupled at one end to the neck and coupled at another end to the soundboard, playing at least one string by plucking the at least one string, and altering the pitch of the at least one string.

The foregoing and other objects, features, and advantages of the present invention will be apparent from the following, more particular, description of the preferred embodiments of the invention, as illustrated in the accompanying drawings.

DETAILED DESCRIPTION OF THE PREFERRED EMBODIMENTS

Figure 1:
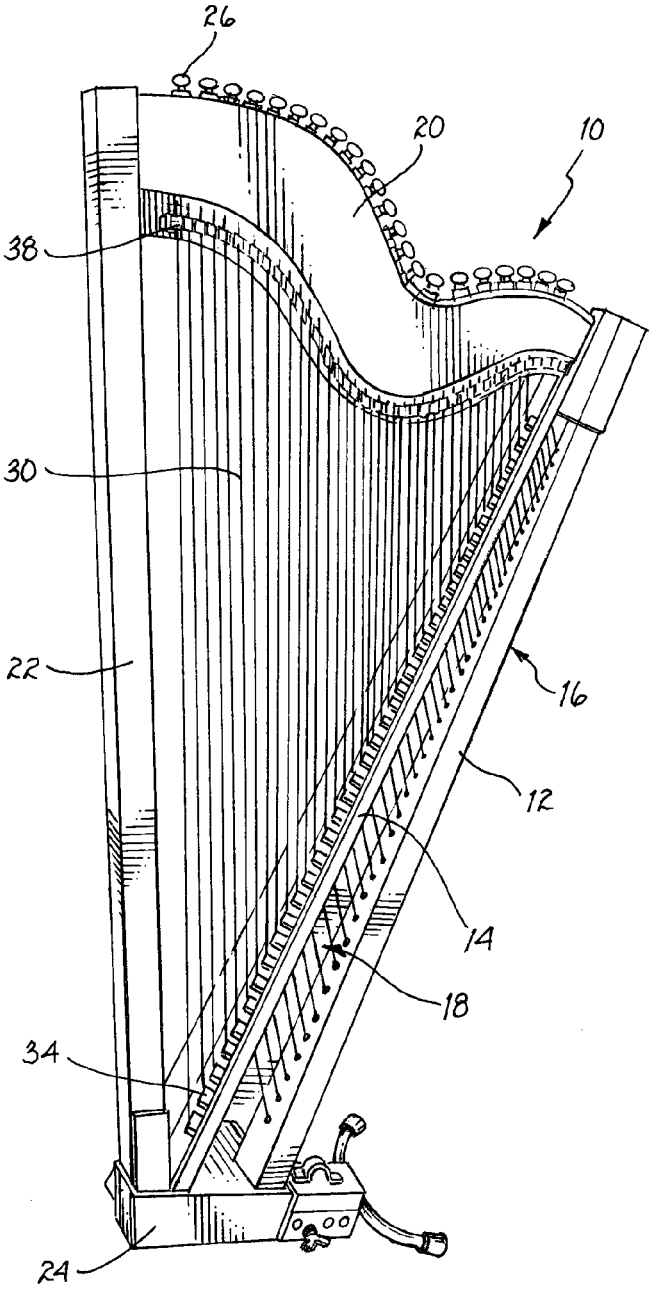
FIG. 1 is a left side perspective view of a harp of the present invention.

The novel features believed characteristic of the invention are set forth in the appended claims. The invention will best be understood by reference to the following detailed description of illustrated embodiments when read in conjunction with the accompanying drawings, wherein like reference numerals and symbols represent like elements.

FIGS. 1-6 together disclose a harp, hereinafter harp 10. The harp 10 comprises a soundboard 12, a neck 20, a column 22, a foot 24, tuning pegs 26, and strings 30 coupled at one end to the neck 20 and coupled at another end to the soundboard 12. The harp 10 of the present invention has means for altering the pitch of the strings 30 so that each string 30 on the harp 10 is capable of playing three notes.

Figure 1A:
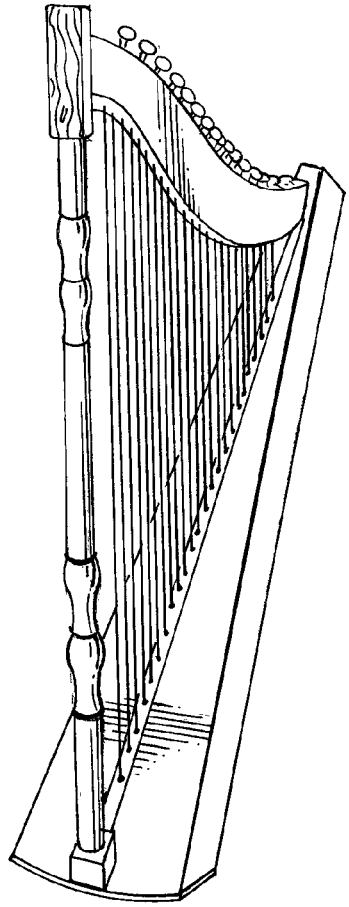
FIG. 1A (PRIOR ART)
FIG. 1*a* is a front perspective view of a prior art harp, specifically a Paraguayan harp.

FIG. 1A shows a prior art harp, specifically a Paraguayan harp. The prior art harp has a soundboard, a neck extending outwardly from a top end of the soundboard, a column (or forepillar) extending downwardly from a distal end of the neck, a foot coupled to a bottom end of the column and to a bottom end of the soundboard, a plurality of tuning pegs coupled along a top surface of the neck, and a plurality of strings, each string being coupled at one end to the neck and coupled at another end to the soundboard.

Referring to the embodiment shown in FIG. 1, the pitch of a string 30 may be altered by creating a pitch bend effect. A pitch bend effect, i.e. vibrato or portamento, occurs when a player 40 quickly varies the tension and sometimes the length of a string 30. This temporarily causes a vocal slide between two pitches. This pitch bend effect is commonly described as a "twang" type of sound and is most commonly achieved by a tremolo arm or "whammy bar" on an electric guitar.

In FIG. 1, the harp 10 is shown as having an exposed soundboard 12. The soundboard 12 has a top portion 14, a bottom portion 16, and an open space 18 that is defined by the top portion 14 and the bottom portion 16 of the soundboard 12. The strings 30 pass through the top portion 14, traverse the open space 18, and are coupled to the bottom portion 16 of the soundboard 12. The open space 18 may be any size, as long as it is wide enough to fit the hand of the player 40, therefore allowing the player 40 to take hold of the string 30 and bend it. When the player 40 bends a string 30 within the open space 18, a pitch bend effect will result on that string 30. It should be clearly understood that the string 30 may be bent before or after plucking the string 30.

Figure 2:
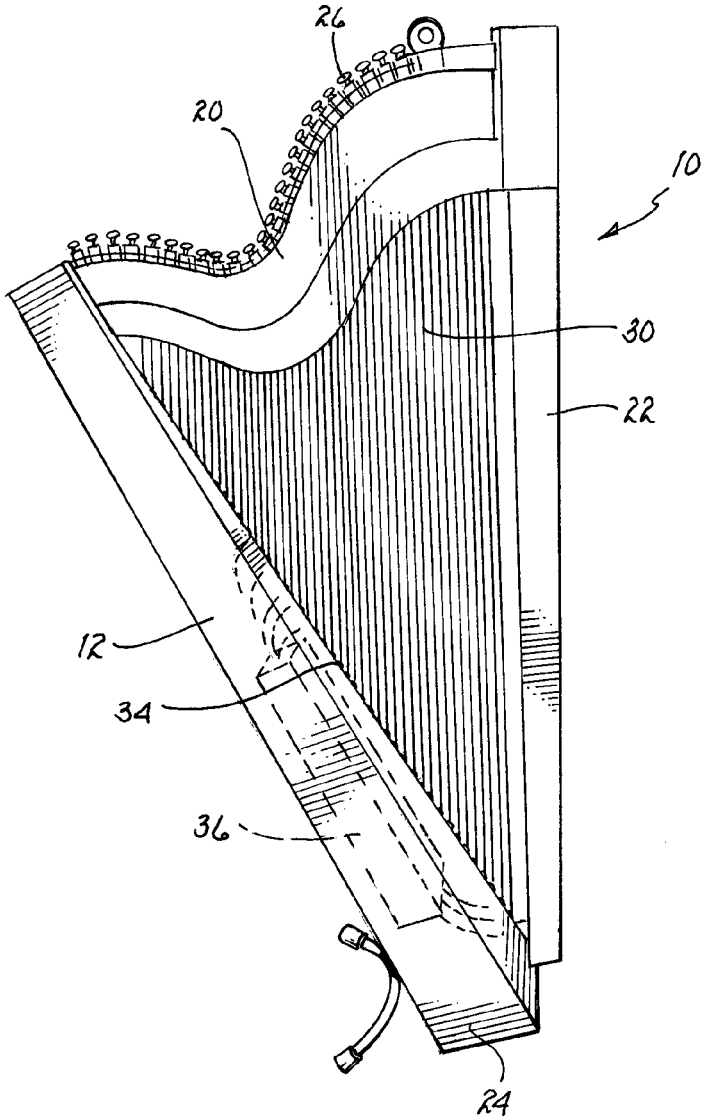
FIG. 2 is a right side view of the harp of FIG. 1.

Referring to FIG. 2, the harp 10 may have a plurality of pick-up microphones 34, wherein each pick-up microphone 34 is positioned proximate a corresponding string 30 and is coupled to an electronic circuit board 36 for amplification of the string 30. In the embodiment shown in FIG. 2, the electronic circuit board 36 may be housed within the soundboard 12, although it should be clearly understood that substantial benefit may be derived from the electronic circuit board 36 being coupled in an alternate location. It should also be clearly understood that use of an electronic circuit board 36 is not required. While the pick-up microphones 34 are shown to be coupled to a top surface of the top portion 14 of the soundboard 12, it should be clearly understood that substantial benefit may be derived from the pick-up microphones 34 being positioned in an alternate location, so long as the pick-up microphones 34 are capable of picking up the vibration of their corresponding strings 30.

Figure 3A:
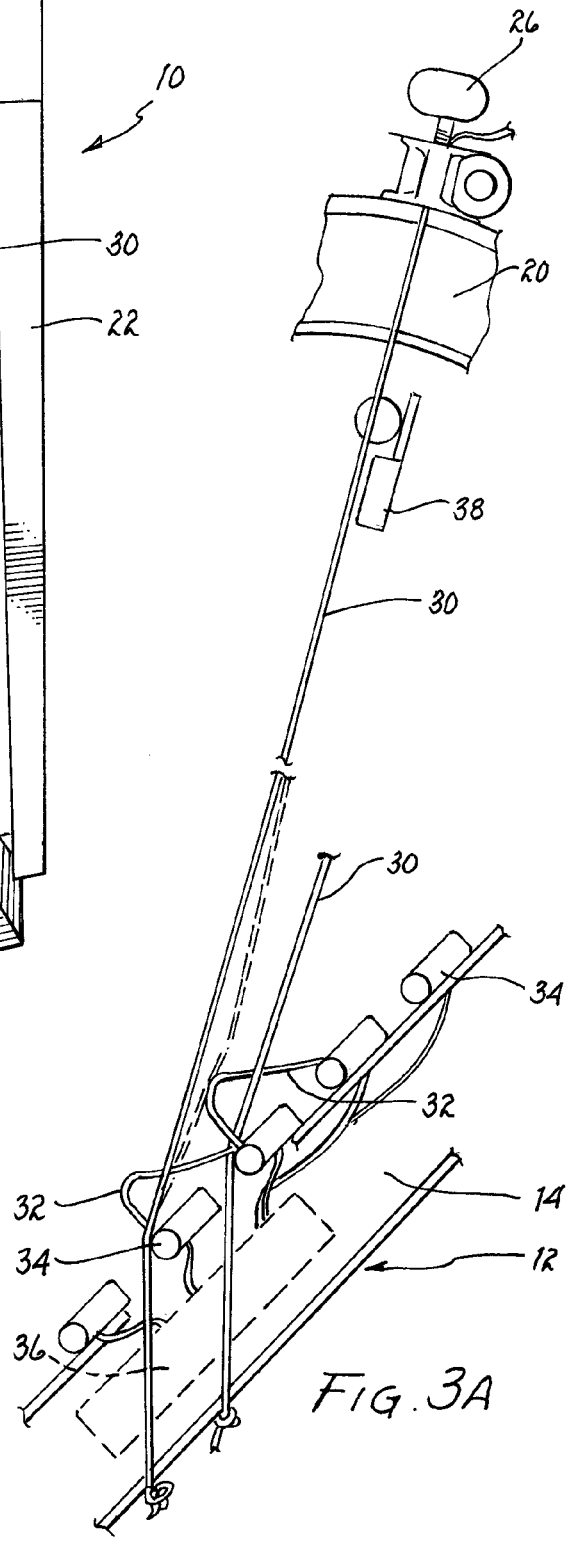
FIG. 3*a* is a side view of a string of the harp of FIG. 1 being pressed against a bridge to raise the pitch of the string by a perfect semitone.

FIG. 3*a* shows a string 30 coupled at one end to the neck 20 and coupled at another end to the soundboard 12. Also shown is a tuning peg 26 coupled along a top surface of the neck 20. A lever 38 is shown coupled to the string 30 proximate a bottom surface of the neck 20. When the lever 38 is in a first position, the pitch of the corresponding string 30 is raised by a semitone. For example, if the string 30 is a G natural, placing the lever 38 in the first position would raise the pitch of the string 30 to a G sharp.

Figure 3:
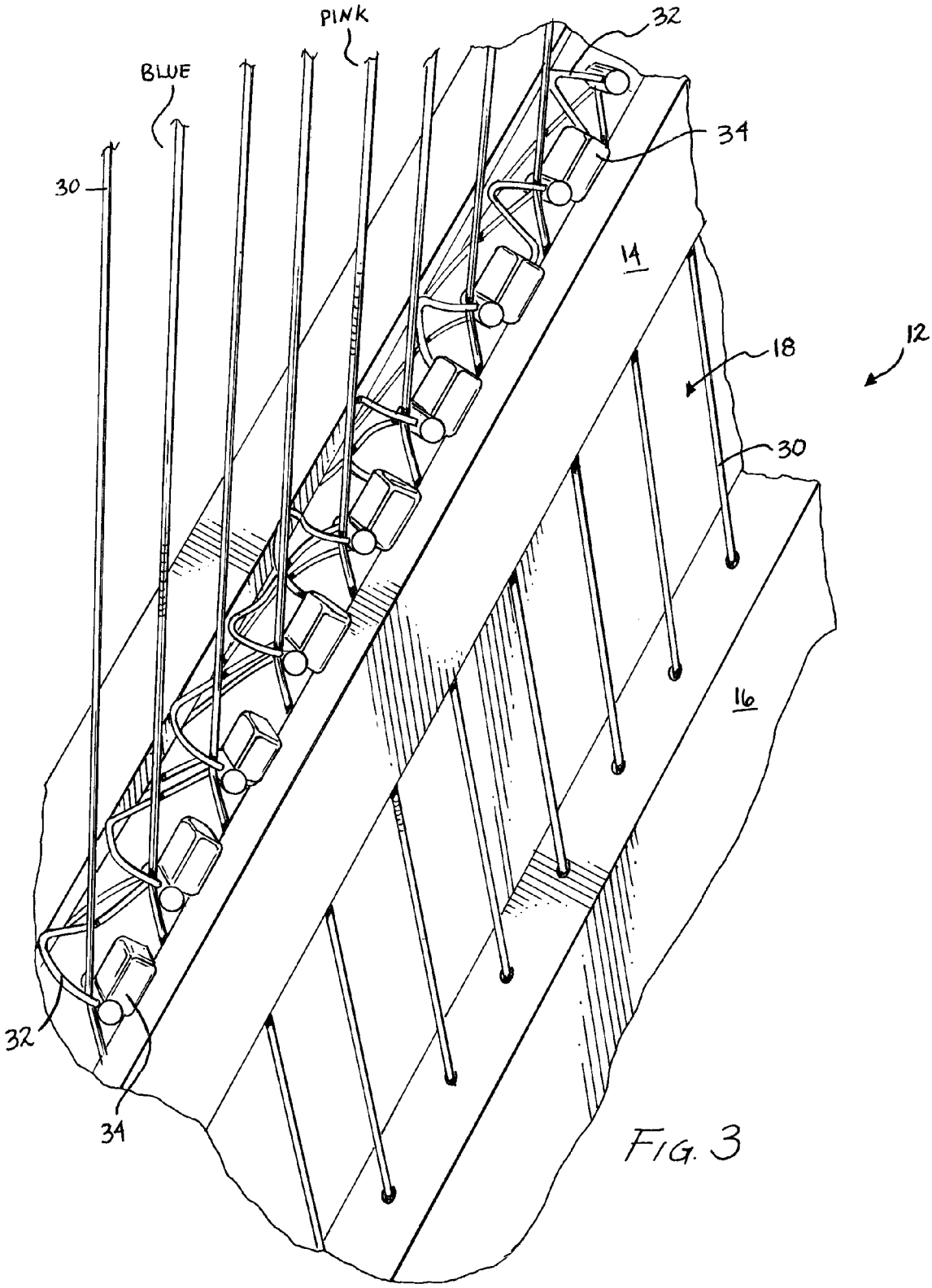
FIG. 3 is a perspective view of the exposed soundboard of the harp of FIG. 1.

The harp 10 of the present invention has means for creating rising half tones in the strings 30. Previously, players 40 have pressed the strings 30 directly unto the soundboard 12, but that method does not produce a perfect semitone. Referring to FIG. 3, the harp 10 has a plurality of bridges 32 that function in a way similar to the frets of a guitar. The bridges 32 are shown coupled along a top surface of the top portion 14 of the soundboard 12. The bridges 32 may be made of metal wire, however, it should be clearly understood that substantial benefit may be derived from the bridges 32 being made of some other suitable material.

Each bridge 32 is positioned at a predetermined distance from the top surface of the top portion 14 of the soundboard 12 because the bridge 32 must contact the string 30 at a precise point in order to achieve a perfect semitone. The point at which the bridge 32 must contact the string 30 may be determined by using a tuner to find the exact pitch frequency for the semitone. When a player 40 presses a string 30 against a corresponding bridge 32, the pitch of the string 30 is raised by exactly one semitone.

Statement of Operation

Figure 4:
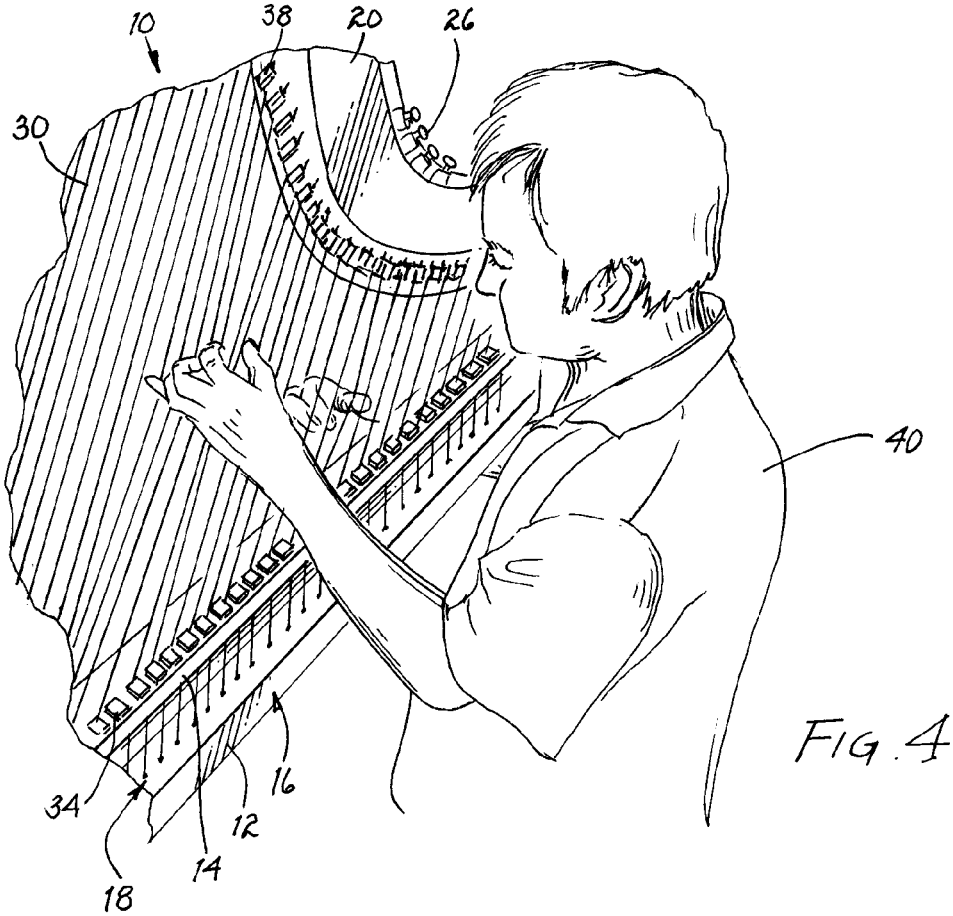
FIG. 4 is a perspective view of the harp of FIG. 1 in use.
Figure 5:
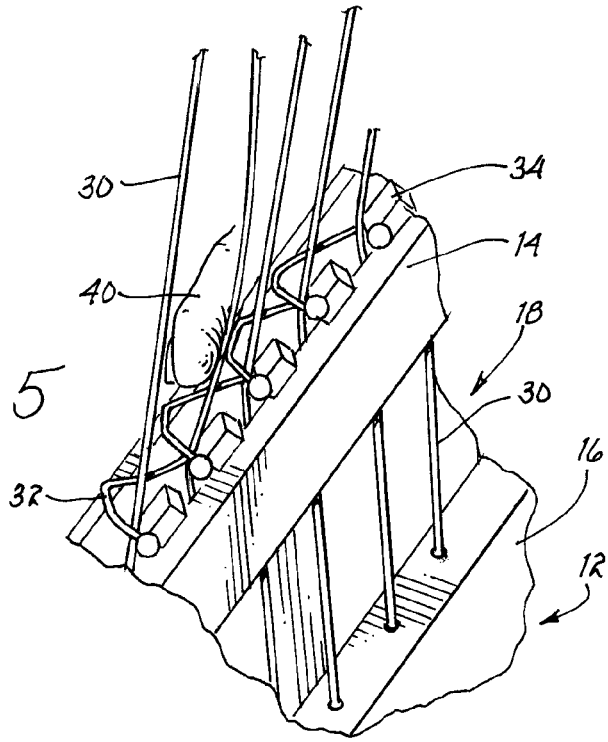
FIG. 5 is a perspective view of a string of the harp of FIG. 1 being pressed against the bridge to raise the pitch of the string by a perfect semitone.
Figure 6:
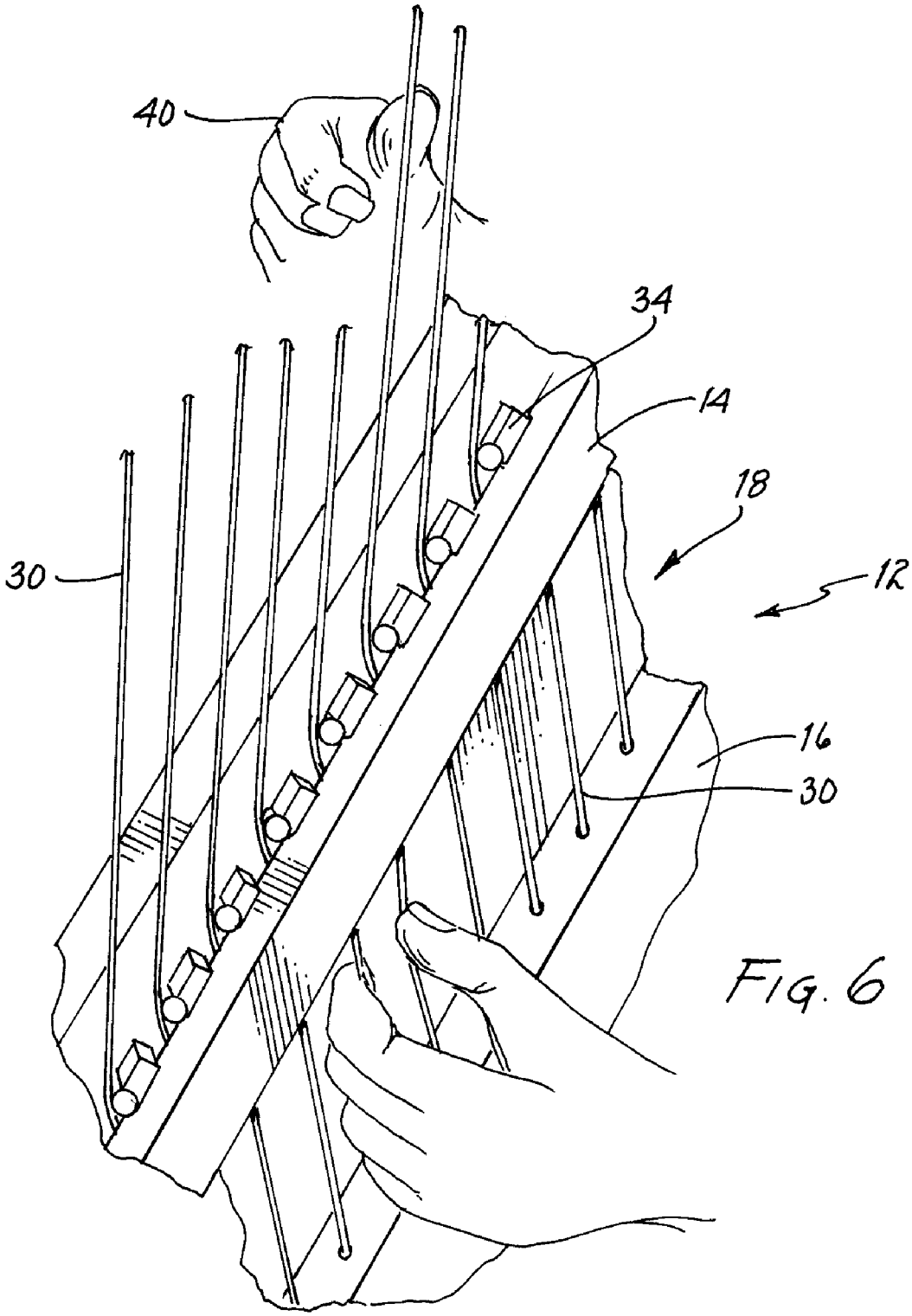
FIG. 6 is a perspective view of a string of the harp of FIG. 1 being bent in the open space of the soundboard to create a pitch bend effect.

FIGS. 4-6 show the harp 10 of the present invention being played. To play a string 30, it must be plucked by the player 40. The harp 30 allows a player 40 to alter the pitch of a string 30 in several ways.

One way to alter the pitch is to create a pitch bend effect on a string 30. After plucking a string 30, the player 40 may then bend the string 30 within the open space 18 of the exposed soundboard 12, thus causing the pitch bend effect on the string 30.

Another way to alter the pitch of a string 30 is to press the string 30 against its corresponding bridge 32. Pressing the string 30 against the bridge 32 shortens the length of the string 30 and increases the pitch of the string 30 by exactly one semitone.

And finally, one other way to alter the pitch of a string 30 is to move its corresponding lever 38 into a first position to raise the pitch of the string 30 by a semitone.

In total, each string 30 on the harp 10 may play up to three notes. For example, if an open string 30 plays a C natural, a lever 38 may be placed in the first position to raise the pitch of the string 30 by a semitone to C sharp. By pressing the same string 30 against its corresponding bridge 32, the pitch of the string 30 will be raised by another semitone to a D natural. And by bending the same string 30 in the open space 18 of the soundboard 12, the pitch of the string 30 may be raised again by a semitone to D sharp or even by a whole tone to E natural. Depending upon how much the string 30 is bent, the pitch may rise to any pitch level between D natural and even to a pitch level slightly higher than E natural.

While the invention has been particularly shown and described with reference to preferred embodiments thereof, it will be understood by those skilled in the art that the foregoing and other changes in form and details may be made therein without departing from the spirit and scope of the invention. For example, while it is shown that the means for creating a pitch bending effect and the means for creating rising half tones in the strings are used on a Paraguayan harp, it should be clearly understood that those means may be used on any other type of harp.

I claim:

1. A harp comprising:

a soundboard;

a neck extending outwardly from a top end of the soundboard;

a column extending downwardly from a distal end of the neck;

a foot coupled to a bottom end of the column and to a bottom end of the soundboard;

a plurality of tuning pegs coupled along a top surface of the neck;

a plurality of strings, each string being coupled at one end to the neck and coupled at another end to the soundboard; and a plurality of bridges coupled along a top surface of a top portion of the soundboard, wherein each string has a separate corresponding bridge, and wherein each bridge is a wire that is positioned at a predetermined distance from the top surface of the top portion of the soundboard in order to contact its corresponding string at a predetermined point on the string;

wherein pressing a string against its corresponding wire bridge raises the pitch of the string by a semitone; and wherein each predetermined point of contact between each string and its corresponding wire bridge depends upon a note of the string.

2. The harp of claim 1 further comprising means for creating a pitch bend effect on at least one string.

3. The harp of claim 2 wherein the means for creating a pitch bend effect on the at least one string comprises:

an exposed soundboard comprising:

a top portion;

a bottom portion; and an open space defined by the top portion and the bottom portion of the soundboard;

wherein the strings pass through the top portion of the soundboard, traverse the open space, and are coupled to the bottom portion of the soundboard;

wherein the open space is wide enough to allow a hand of a person to take hold of the at least one string and to bend the at least one string within the open space; and wherein bending the at least one string within the open space causes the pitch bend effect on the at least one string.

4. The harp of claim 1 further comprising a plurality of pick-up microphones coupled to the soundboard, wherein each pick-up microphone is positioned proximate a corresponding string and is coupled to an electronic circuit board for amplification of the string.

5. The harp of claim 1 further comprising a plurality of levers, each lever coupled to a string proximate a bottom surface of the neck, wherein a first position of each lever raises the pitch of a corresponding string by a semitone.

6. A harp comprising:

an exposed soundboard having:

a top portion;

a bottom portion; and an open space defined by the top portion and the bottom portion of the exposed soundboard;

a neck extending outwardly from a top end of the exposed soundboard;

a column extending downwardly from a distal end of the neck;

a foot coupled to a bottom end of the column and to a bottom end of the exposed soundboard;

a plurality of tuning pegs coupled along a top surface of the neck;

a plurality of strings, each string being coupled at one end to the neck and coupled at another end to the exposed soundboard;

wherein the strings pass through the top portion of the exposed soundboard, traverse the open space, and are coupled to the bottom portion of the exposed soundboard;

wherein the open space is wide enough to allow a hand of a person to take hold of the strings and to bend the strings within the open space; and wherein bending a string within the open space raises the pitch of the string by up to two semitones.

7. The harp of claim 6 further comprising means for creating rising half tones in the strings.

8. The harp of claim 7 wherein the means for creating rising half tones comprises a plurality of bridges coupled along a top surface of a top portion of the exposed soundboard, wherein each string has a corresponding bridge, and wherein each bridge is a wire that is positioned at a predetermined distance from the top surface of the top portion of the exposed soundboard in order to contact its corresponding string at a predetermined point on the string, wherein pressing a string against its corresponding wire bridge raises the pitch of the string by a semitone, and wherein each predetermined point of contact between each string and its corresponding wire bridge depends upon a note of the string.

9. The harp of claim 6 further comprising a plurality of pick-up microphones coupled to a top surface of a top portion of the soundboard, wherein each pick-up microphone is positioned proximate a corresponding string and is coupled to an electronic circuit board for amplification of the string.

10. The harp of claim 6 further comprising a plurality of levers, each lever coupled to a string proximate a bottom surface of the neck, wherein a first position of each lever raises the pitch of a corresponding string by a semitone.

11. A harp comprising:

an exposed soundboard comprising:

a top portion;

a bottom portion; and an open space defined by the top portion and the bottom portion;

a neck extending outwardly from a top end of the soundboard;

a column extending downwardly from a distal end of the neck;

a foot coupled to a bottom end of the column and to a bottom end of the soundboard;

a plurality of tuning pegs coupled along a top surface of the neck;

a plurality of strings, wherein each string is coupled at one end to the neck, passes through the top portion of the soundboard, is coupled to the bottom portion of the soundboard, and traverses the open space defined by the top portion and the bottom portion of the soundboard, wherein the open space is wide enough to allow a hand of a person to take hold of the strings and to bend the strings within the open space, and wherein bending a string within the open space causes a pitch bend effect on the string, raising the pitch of the string by up to two semitones; and a plurality of bridges coupled along a top surface of the top portion of the soundboard, wherein each string has a separate corresponding bridge, wherein each bridge is a wire that is positioned at a predetermined distance from the top surface of the top portion of the soundboard in order to contact its corresponding string at a predetermined point on the string, wherein pressing a string against its corresponding wire bridge raises the pitch of the string by exactly a semitone, and wherein each predetermined point of contact between each string and its corresponding wire bridge depends upon a note of the string.

12. The harp of claim 11 further comprising a plurality of levers, each lever coupled to a string proximate a bottom surface of the neck, wherein a first position of each lever raises the pitch of a corresponding string by a semitone.

13. The harp of claim 11 wherein the bridges are constructed of metal wire.

14. The harp of claim 11 further comprising a plurality of pick-up microphones coupled to the soundboard, wherein each pick-up microphone is positioned proximate a corresponding string and is coupled to an electronic circuit board for amplification of the string.

15. A method of playing a harp comprising the steps of:

providing a harp comprising:

a soundboard;

a neck extending outwardly from a top end of the soundboard;

a column extending downwardly from a distal end of the neck;

a foot coupled to a bottom end of the column and to a bottom end of the soundboard;

a plurality of tuning pegs coupled along a top surface of the neck; and a plurality of strings, each string being coupled at one end to the neck and coupled at another end to the soundboard;

playing at least one string by plucking the at least one string; and altering the pitch of the at least one string, wherein the step of altering the pitch of the at least one string comprises the steps of:

providing an exposed soundboard comprising:

a top portion;

a bottom portion; and an open space defined by the top portion and the bottom portion;

wherein each string is coupled at one end to the neck, passes through the top portion of the soundboard, is coupled to the bottom portion of the soundboard, and traverses the open space defined by the top portion and the bottom portion of the soundboard; and bending the at least one string within the open space of the exposed soundboard causing a pitch bend effect on the at least one string.

16. The method of claim 15 wherein the step of altering the pitch of the at least one string further comprises the steps of:

providing a plurality of levers, each lever coupled to a string proximate a bottom surface of the neck; and moving at least one lever into a first position;

wherein moving the at least one lever into a first position raises the pitch of a corresponding string by a semitone.

17. The method of claim 15 wherein the step of altering the pitch of the at least one string further comprises the steps of:

providing a plurality of bridges coupled along a top surface of the top portion of the soundboard, each bridge being positioned at a predetermined distance from the top surface of the top portion of the soundboard; and pressing a string against a corresponding bridge to raise the pitch of the string by a semitone.

18. A method of playing a harp comprising the steps of:

providing a harp comprising:

a soundboard;

a neck extending outwardly from a top end of the soundboard;

a column extending downwardly from a distal end of the neck;

a foot coupled to a bottom end of the column and to a bottom end of the soundboard;

a plurality of tuning pegs coupled along a top surface of the neck; and a plurality of strings, each string being coupled at one end to the neck and coupled at another end to the soundboard;

playing at least one string by plucking the at least one string; and altering the pitch of the at least one string, wherein the step of altering the pitch of the at least one string comprises the steps of:

providing a plurality of bridges coupled along a top surface of the top portion of the soundboard, each bridge being positioned at a predetermined distance from the top surface of the top portion of the soundboard; and pressing a string against a corresponding bridge to raise the pitch of the string by a semitone.

19. The method of claim 18 wherein the step of altering the pitch of the at least one string further comprises the steps of:

providing an exposed soundboard comprising:

a top portion;

a bottom portion; and an open space defined by the top portion and the bottom portion;

wherein each string is coupled at one end to the neck, passes through the top portion of the soundboard, is coupled to the bottom portion of the soundboard, and traverses the open space defined by the top portion and the bottom portion of the soundboard; and bending the at least one string within the open space of the exposed soundboard causing a pitch bend effect on the at least one string.

20. The method of claim 18 wherein the step of altering the pitch of the at least one string further comprises the steps of:

providing a plurality of levers, each lever coupled to a string proximate a bottom surface of the neck; and moving at least one lever into a first position;

wherein moving the at least one lever into a first position raises the pitch of a corresponding string by a semitone.

* * * * *